US005385450A

United States Patent [19]

Kimura et al.

[11] Patent Number: 5,385,450

[45] Date of Patent: Jan. 31, 1995

[54] RECIPROCATING-PISTON TYPE REFRIGERANT COMPRESSOR WITH AN IMPROVED ROTARY-TYPE SUCTION-VALVE MECHANISM

[75] Inventors: Kazuya Kimura; Shigeyuki Hidaka; Hideki Mizutani; Toru Takeichi, all of Kariya, Japan

[73] Assignee: Kabushiki Kaisha Toyoda Jidoshokki Seisakusho, Aichi, Japan

[21] Appl. No.: 131,449

[22] Filed: Oct. 4, 1993

[30] Foreign Application Priority Data

Oct. 2, 1992 [JP] Japan ..... 4-265017

[51] Int. Cl.[6] ..... F04B 1/12

[52] U.S. Cl. ..... 417/269; 91/480; 91/499; 137/312; 137/625.11

[58] Field of Search ..... 417/269, 516, 532, 539, 417/222.1, 222.2; 91/480, 484, 499; 137/312, 625.11, 625.47

[56] References Cited

U.S. PATENT DOCUMENTS 1,367,914 2/1921 Larsson .
3,554,224 1/1971 Kirk et al. ..... 137/625.11
5,232,349 8/1993 Kimura et al. ..... 417/222.1

FOREIGN PATENT DOCUMENTS 350135 3/1922 Germany .
59-145378 8/1984 Japan .
5231308 2/1992 Japan .
571467 3/1993 Japan .

*Primary Examiner*—Richard A. Bertsch
*Assistant Examiner*—Alfred Basichas
*Attorney, Agent, or Firm*—Burgess, Ryan & Wayne

[57] ABSTRACT

A reciprocating-piston-type refrigerant compressor provided with a cylinder block having formed therein a plurality of cylinder bores in which a plurality of pistons are reciprocated to effect suction, compression and discharge of refrigerant gas in response to rotation of a drive shaft, a rotary valve element connected to the drive shaft to be rotated together with the drive shaft within a recessed chamber formed in the cylinder block, the valve element having an outer circumference in sliding contact with the inner wall of the recessed chamber and a suction passageway for sequentially introducing the refrigerant gas before compression into the plurality of cylinder bores during the rotation of the rotary valve element. A sealing mechanism is provided between opposite ends of the outer circumference of the rotary valve element and the inner wall of the recessed chamber to prevent the compressed refrigerant gas from leaking from the contact area of the rotary valve element and the inner wall of the recessed chamber toward a low pressure region of the compressor during rotation of the rotary valve element.

10 Claims, 5 Drawing Sheets

RECIPROCATING-PISTON TYPE REFRIGERANT COMPRESSOR WITH AN IMPROVED ROTARY-TYPE SUCTION-VALVE MECHANISM

BACKGROUND OF THE INVENTION

1. Field of the Invention

The present invention relates to a reciprocating-piston type refrigerant compressor adapted for use in compression of a refrigerant gas for an air-conditioning system of an automobile, which is provided with a refrigerant-gas-suction mechanism including a rotary-type suction valve fixed to a rotatable drive shaft to which an external drive force is applied by the engine of the automobile so as to operate the compressor. More particularly, it relates to a rotary-type suction valve mechanism, accommodated in the above-described reciprocating-piston type refrigerant compressor, which has an improved internal construction enabling it to maintain adequate volumetric compression efficiency and also adequate drive force-to-work efficiency while suppressing a rise in the temperature of the discharged refrigerant gas.

2. Description of the Related Art

A typical reciprocating-piston-type compressor is disclosed in, for example, Japanese Unexamined Patent publication (Kokai) No. 59-145378, in which a swash-plate-type rotation-to-reciprocation conversion mechanism is mounted on a drive shaft to reciprocate the pistons in a plurality of axial cylinder bores formed in a cylinder block arranged to be in parallel with the rotating axis of the drive shaft. The reciprocation of the pistons in the cylinder bores of the cylinder block pumps refrigerant gas into the cylinder bores, compresses the pumped refrigerant gas within the cylinder bores, and discharges the compressed refrigerant gas from the cylinder bores. The above-described reciprocating-piston type compressor is provided with housings attached to both ends of the cylinder block via valve plates, and the housings define therein suction chambers for receiving the refrigerant gas before compression to be supplied into the cylinder bores and discharge chambers for receiving the refrigerant gas after compression discharged from the cylinder bores. The supply of the refrigerant gas from the suction chambers toward the cylinder bores is carried out through suction ports bored in the valve plates when the suction ports are opened by suction valves attached to the inner face of each valve plate. The suction valve in the shape of a flapper type valve is arranged so as to be moved from a suction-port closing position toward a suction-port opening position in response to a reduction of gas pressure in the related cylinder bore during the movement of the associated reciprocating piston from the top dead center thereof toward the bottom dead center thereof in the cylinder bore. The discharge of the compressed refrigerant gas from each of the respective cylinder bores toward the discharge chambers of the housings carried out through discharge ports bored in the valve plates when the discharge ports are opened by flapper-type discharge valves attached to the outer face of each of-the valve plates. Each discharge valve is moved from a discharge-port closing position to a discharge-port opening position when the related piston is moved from the bottom dead center thereof toward the top dead center thereof within the corresponding cylinder bore.

In the above-described conventional reciprocating-piston type compressor, the flapper-type suction valves made of an elastic material are elastically urged toward the respective suction-port closing positions, and are moved toward the respective suction-port opening positions against the elastic force exerted by themselves, Namely, the suction valve is not able to be quickly moved from the suction-port closing position thereof to the suction-port opening position thereof during the suction phase of the related cylinder bore, and accordingly, a large amount of loss of suction pressure occurs, which lowers the volumetric compression efficiency.

Further, in the conventional reciprocating-piston type compressor, it is not possible to prevent a minor part of the compressed gas from remaining in the cylinder bores in the phase of an ending stage of a discharging operation. That is, the minor part of the compressed refrigerant gas remains as a high pressure residual gas in a small space between the pistons at the top dead center thereof and the valve plates and/or in the discharge ports of the valve plates. The high pressure residual gas is subsequently expanded in the cylinder bores in the phase of a suction operation in response to the movement of the pistons toward the bottom dead center. The expansion of the residual high pressure gas in the cylinder bores blocks fresh suction of the refrigerant gas before compression from the suction chambers into the respective cylinder bores in the phase of an initial stage of the suction operation. Namely, an amount of the suction of the refrigerant gas into the respective cylinder bores is reduced. Therefore, a volumetric compression efficiency of the compressor attributed to a given amount of loss of suction pressure occurs.

To overcome the above-mentioned defect of the conventional reciprocating-piston type compressor with the flapper-type suction valve mechanism, Japanese Unexamined Patent Application (Kokai) No. 5-71467 (JP-A-5-71467) filed by Kabushiki Kaisha Toyoda Jidoshokki Seisakusho corresponding to the Assignee company of the present U.S. Patent Application has proposed a reciprocating-piston type compressor provided with a suction valve mechanism improved so as to appreciably increase the volumetric compression efficiency of the compressor.

In the proposed reciprocating-piston type compressor of JP-A-5-71467, a rotary type suction valve element connected to a drive shaft to be rotated together with the drive shaft is used for successively supplying respective cylinder bores of the compressor with suction refrigerant gas during the rotation thereof in a cylindrical chamber centrally recessed in the cylinder block of the compressor. The rotary-type suction valve element has a suction passageway formed therein to provide a fluid communication between a suction chamber of the compressor and the respective cylinder bores in the suction phase, via communication passageways radially extending between the cylindrical chamber and the respective cylinder bores of the cylinder block. The use of the rotary-type suction valve element is effective for smoothly and constantly supplying the refrigerant gas from the suction chamber into respective cylinder bores.

Further, the rotary-type suction valve element of the compressor of JP-A-5-71467 is also provided with a bypass passageway for routing residual refrigerant gas, i.e., the part of the compressed refrigerant gas remaining in respective cylinder bores without being discharged therefrom at the final stage of the discharging phase, toward respective cylinder bores which are at the initial stage of the compression phase. Accordingly, a loss of suction pressure in each of the respective cylinder bores of the compressor of JP-A-5-71467 can be appreciably reduced. Thus, the reciprocating-piston type compressor is able to exhibit an adequate volumetric compression efficiency.

Another reciprocating-piston type refrigerant compressor with an improved rotary valve has been proposed in Japanese Patent Application No, 4-33645 filed by Kabushiki Kaisha Toyoda Jidoshokki Seisakusho corresponding to the Assignee company of the present U.S. Patent Application, and will be published by the Japanese Patent Office at around the end of 1993 or the beginning of 1994. The rotary valve of the compressor is provided with a suction passageway for successively distributing a refrigerant gas before compression supplied from a suction chamber into respective cylinder bores during rotation thereof, and also a grooved passageway means formed in the outer circumference thereof for capturing the compressed refrigerant gas when it leaks from the cylinder bores in the phase of a discharging operation to thereby quickly route the captured gas toward the respective cylinder bores in the phase of an initial stage of compressing operation after the completion of the suction operation, (i.e., the cylinder bores in which the corresponding pistons are at the bottom dead center thereof to start the compressing stroke ). Accordingly, the leaking refrigerant gas can be re-compressed in the respective cylinder bores in the phase of compressing operation. Thus, the leaking gas under high pressure will not subjected to expansion. Therefore, the respective cylinder bores are able to pump in a sufficient amount of the refrigerant gas before compression during the suction-operation phase to thereby maintain an adequate volumetric compression efficiency.

However, the compressors of JP-A-5-71467 and Japanese Patent Application No. 4-33645 still suffer from the defects described below.

When one of these compressors is driven by a drive force given to the drive shaft, the rotary-type suction valve rotates in the cylindrical chamber of the cylinder block so as to distribute the refrigerant gas into respective cylinder bores in the suction phase. The rotary-type suction valve element is constantly in sliding contact with the inner wall of the cylindrical chamber, and accordingly, the inner wall of the cylindrical chamber functions as an air-tight valve seat capable of preventing the refrigerant gas under high pressure from leaking from respective cylinder bores. It is, however, impossible to completely prevent a part of the refrigerant gas under high pressure from leaking out of respective cylinder bores in the compressing and/or discharging phases into the contacting area between the cylindrical chamber and the rotary-type suction valve element by way of the afore-mentioned radial communication passageways of the cylinder block.

At this stage, since the compressors of JP-A-5-71467 and of Japanese Patent Application No. 4-33645 are not provided with any means for appropriately returning the leaking refrigerant gas toward respective cylinder bores in the compressing and/or discharging phase, the refrigerant gas leaking from the contacting area between the cylindrical chamber and the rotary-type suction valve element gradually enters a lower pressure region within the compressor body such as the suction chamber communicating with the cylindrical chamber of the cylinder block, the wobble plate chamber or crank chamber communicating with one end of the rotary-type suction valve element, and the suction passageway of the valve element per se. Consequently, the lowering of the volumetric compression efficiency of the compressor cannot be avoided. The lowering of the volumetric compression efficiency brings about a reduction in the amount of the compressed refrigerant gas circulating through the air-conditioning system, Further, in spite of the above-mentioned lowering of the volumetric compression efficiency and the reduction in the circulating amount of the compressed refrigerant gas, the drive force necessary for operating the compressor is not reduced, and thus a ratio between the drive force presented to the compressor by an external drive source such as an automobile engine and a work done by the compressor, i.e., the drive force-to-work efficiency is low, and the temperature of the compressed refrigerant gas measured at the delivery port of the compressor is high. This high temperature of the compressed refrigerant gas adversely affects the function of the condenser of the air-conditioning system, and accordingly, the performance of the air-conditioning system is degraded.

SUMMARY OF THE INVENTION

Therefore, an object of the present invention is to obviate the defects encountered by the reciprocating-piston type compressor with the conventional rotary-type suction valve mechanism.

Another object of the present invention is to provide a reciprocating-piston type compressor provided with a rotary-type suction valve mechanism improved so as to exhibit appreciably higher volumetric compression efficiency and drive force-to-work efficiency, and being capable of preventing the rise in the temperature of the compressed refrigerant gas delivered from the compressor.

In accordance with the present invention, there is provided a reciprocating-piston type refrigerant compressor provided with a body including a cylinder block having a central bore extending axially about a central axis, a plurality of axial cylinder bores formed in the cylinder block of the body and arranged around the central axis of the cylinder block, a crank or swash plate chamber formed in the body as an independent chamber separate from the cylinder bores of the cylinder block, an axial drive shaft extending through the crank chamber and rotatably supported in the body, the axial drive shaft having one end disposed in the central bore of the cylinder block, at least one suction-gas-receiving chamber formed in the body for receiving refrigerant gas before compression, and a plurality of reciprocating pistons axially slidably received in the plurality of cylinder bores and reciprocated by a piston drive mechanism arranged in the crank chamber so as to be driven by the drive shaft.

The compressor is characterized by comprising:

a rotary valve unit connected to the one end of the drive shaft so as to rotate together with said drive shaft, the rotary valve unit having a generally cylindrical outer circumference extending between opposite axial ends thereof, and a suction passageway for permitting the refrigerant gas before compression to be pumped from the suction-gas-receiving chamber into respective said cylinder bores in a timed relationship with the reciprocation of said reciprocating pistons; during rotation of said rotary valve unit;

a unit for defining a recessed chamber in the central bore of the cylinder block for rotatably receiving said rotary valve unit, the recessed chamber being surrounded by an inner wall area being in sealing contact with the cylindrical outer circumference of the rotary valve unit; and a sealing unit for providing a gas tight sealing between the outer circumference of the rotary valve unit and the inner wall area of the recessed chamber at predetermined respective positions adjacent to the opposite ends of the rotary valve unit.

The sealing unit may employ a squeeze type seal comprised of a ring-like sealing element having various polygonal cross-sections. Namely, the squeeze type seal may be as a pentagonal seal, a D-ring, a triangle seal, a T-ring, X-ring, and a heart-shape ring. The sealing unit may also employ a lip seal. The sealing unit may comprise a labyrinth means arranged in the contact area between the inner wall of the cylindrical chamber of the cylinder block and the rotary valve unit.

The reciprocating-piston-type refrigerant compressor may further comprise:

a first grooved passageway formed in the outer circumference of the rotary valve unit for receiving a part of the compressed refrigerant gas remaining in the respective cylinder bores in the initial stage of the suction phase immediately after the discharge phase; and a second grooved passageway formed in the outer circumference of the rotary valve unit for routing the part of the compressed refrigerant gas received by the third grooved passageway toward the cylinder bore in the phase of an initial stage of the compressing phase immediately after the suction phase. The second grooved passageway is then connected to the first grooved passageway.

BRIEF DESCRIPTION OF THE DRAWINGS

The above and other objects, features and advantages of the present invention will be made apparent from the ensuing description of preferred embodiments thereof in conjunction with the accompanying drawings wherein.

DESCRIPTION OF THE PREFERRED EMBODIMENTS

Figure 1:
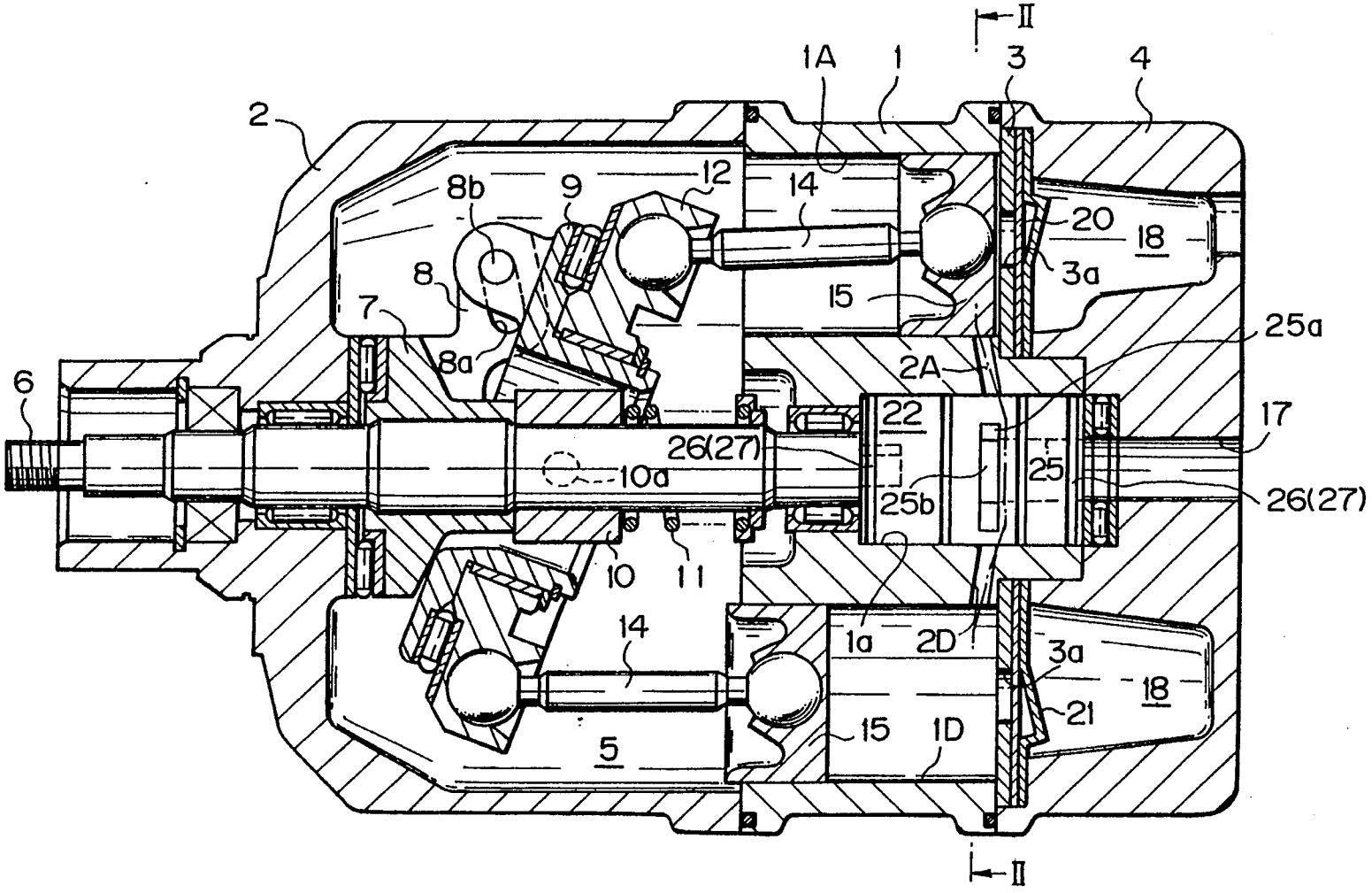
FIG. 1 is a longitudinal cross-sectional view of a reciprocating-piston type compressor with an improved rotary-type suction valve mechanism according to a first embodiment of the present invention.
Figure 2:
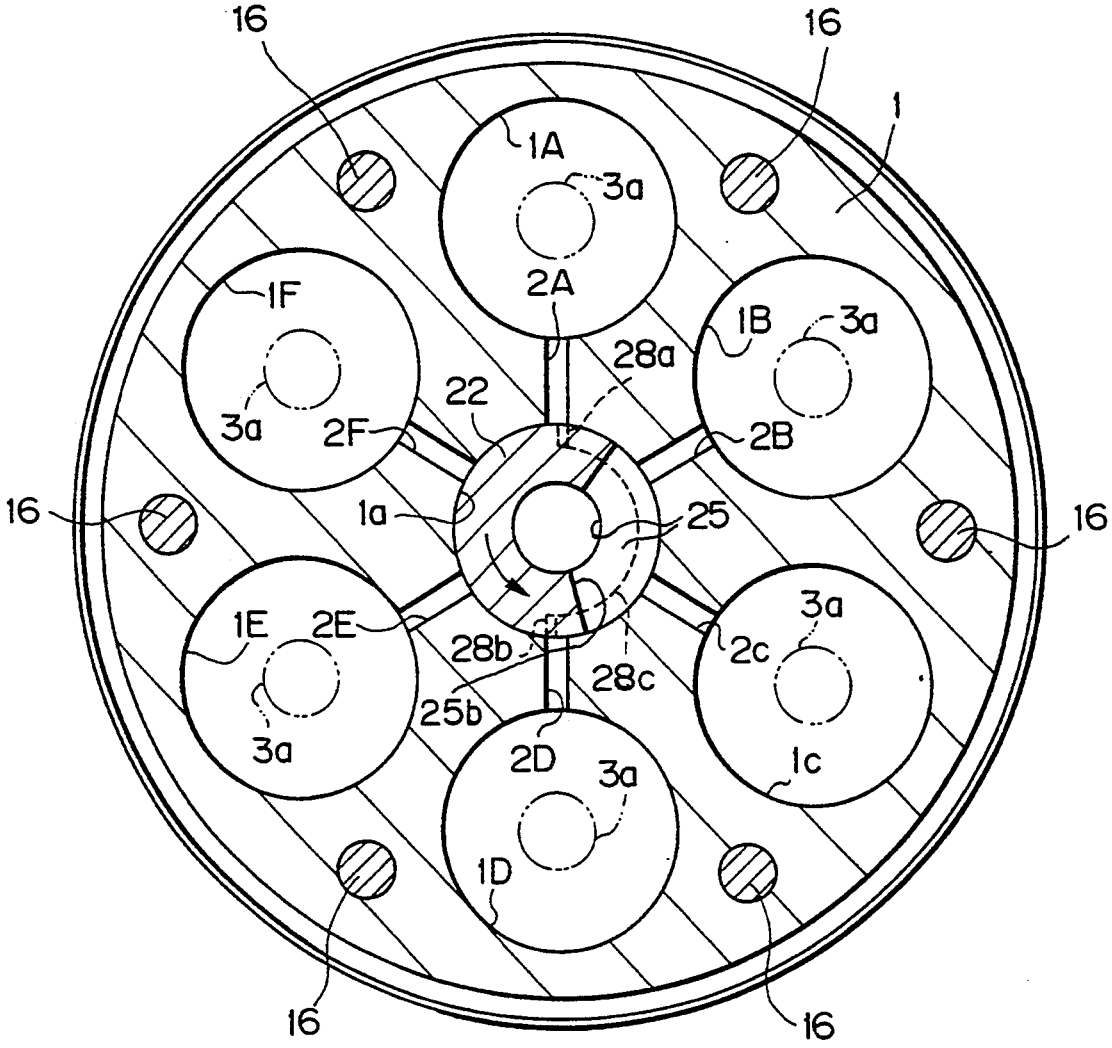
FIG. 2 is a cross-sectional view taken along the line II—II of FIG. 1.

Referring to FIGS. 1 and 2, the compressor of the first embodiment of the present invention is formed as a wobble-plate-operated reciprocating-piston type compressor provided with a compressor body including a cylinder block 1, a front housing 2, and a rear housing 4 which are tightly combined together by a plurality of long screw bolts 16 (FIG. 2). The cylinder block 1 is provided with an axial bore 1*a* centrally formed therein for the purpose of receiving therein a later-described rotary-type valve element. The cylinder block 1 is also provided with a plurality of (six) cylinder bores 1A through 1F in the form of through-bores axially extending between front and rear ends thereof and equiangularly arranged around the axis of the axial bore 1*a*. The front housing 2 is air-tightly attached to the front end of the cylinder block 1 so as to define a crank chamber 5. The rear housing 4 is air-tightly attached to the rear end of the cylinder block 1 via a valve plate 3. A drive shaft 6 is disposed so as to axially extend through the crank chamber 5. The front part of the drive shaft 6 is rotatably supported by a bearing seated in the front housing 2, and the rear part of the drive shaft 6 is rotatably supported by a bearing seated in the central bore 1*a* of the cylinder block 1. The frontmost end of the drive shaft 6 extends outwardly beyond the front housing 2 so as to be connected to an external drive source, i.e., an automobile engine. The rotation of the drive shaft 6 is transmitted to a rotor 7 fixedly mounted on the drive shaft 6. The rotor 7 rotating together with the drive shaft 6 is provided with a rearwardly extending support arm 8 having an elongated hole 8*a* formed in an extreme end of the support arm 8. A connecting pin 8*b* is slidably fit in the elongated bore 8*a* of the support arm 8, and is connected to an inclinable swash plate 9 mounted around the drive shaft 6 so as to be able to change an angle of inclination thereof with respect to a plane extending perpendicularly to the rotating axis of the drive shaft 6. The rotation of the drive shaft 6 is transmitted to the swash plate 9 via the rotor 7 and the connecting pin 8*b*.

A sleeve element 10 is arranged adjacent to the rearmost end of the rotor 7, and is axially slidably mounted on the drive shaft 6 while it is constantly urged toward the rotor 7 by a spring 11. The sleeve element 10 is provided with a pair of lateral trunnion pins 10*a* ( only one of them is shown in FIG. 1) on which the swash plate 9 is pivoted.

A wobble plate 12 is supported on a rear boss of the swash plate 9 via thrust and slide bearings attached to the rear boss of the swash plate 9. Thus, the wobble plate 12 can be free from rotation during the rotation of the swash plate 9. Usually, the wobble plate 12 is prevented from being rotated by an appropriate means such as an engagement of a cut formed in a peripheral portion of the wobble plate 12 and a fixed rod mounted in the compressor body.

The wobble plate 12 is pivotally connected, at the peripheral portion thereof, to respective ends of six equiangularly arranged connecting rods 14 which are pivotally connected to reciprocating-pistons 15, respectively, The reciprocating-pistons 15 are slidably fit in respective cylinder bores 1A through 1F. Thus, the rotation of the drive shaft 6 is converted by the rotor 7 and the swash plate 9 into a nutating motion of the wobble plate 12 about the drive shaft 4, which in turn causes reciprocating motion of respective pistons 15 in the related cylinder bores 1A through 1F. In response to the reciprocating motion of the pistons 15 in respective cylinder bores 1A through 1F, each of the latter cylinder bores 1A through 1F has three sequential operational phases, i.e., a suction phase to pump in the refrigerant gas, a compressing phase to compress the refrigerant gas, and a discharging phase to discharge the refrigerant gas.

In the described wobble-plate-operated reciprocating-piston type compressor, the stroke of reciprocation of respective pistons 15 within the cylinder bores 1A through 1F changes in response to a change in pressure differential between a gas pressure prevailing in the crank case 5 and a suction pressure of the refrigerant gas. Depending on the change of the stroke of the pistons 15, the angle of inclination of the swash and wobble plates 9 and 12 is changed. The gas pressure level in the crank case 5 is adjustably controlled by a control valve (not shown in FIGS. 1 and 2) housed in the rear housing 4 on the basis of air-conditioning load applied to the air-conditioning system.

The rear housing 4 is provided with a central suction chamber 17 in the form of an axial through-bore having an aperture formed in the outer face of the rear housing. The suction chamber 17 is directly communicated with the central bore **1*a* of the cylinder block 1. The rear housing 4 is also provided with a discharge chamber 18 for receiving the compressed refrigerant gas when it is discharged from the respective cylinder bores 1A through 1F. The discharge chamber 18 is arranged around and isolated from the central suction chamber 17. The valve plate 3 is provided with six bore-like discharge ports 3*a* communicated with head portions of respective cylinder bores 1A through 1F, The respective discharge ports 3*a* are closed by flapper-type discharge valves 20 attached to the outer face of the valve plate 3 facing respective discharge chamber 18. The discharge valves 20 are backed up by retainers 21 capable of limiting the movement of the discharge valves 20**.

As best shown in FIG. 2, the cylinder block 1 is provided with radial communication passageways 2A through 2F providing a constant fluid communication between the central bore **1*a* of the cylinder block 1 and respective cylinder bores 1A through 1F, The radial communication passageways 2A through 2F have respective outward openings formed in the head portion of respective cylinder bores 1A through 1F and respective inward openings formed in the cylindrically extending inner wall of the central bore 1*a* of the cylinder block 1, respectively. The inward openings of the communication passageways 2A through 2F are equidistantly spaced from one another as shown in the developed illustration of the cylindrical inner wall of the central bore 1*a* in, for example, FIG. 7**.

A rotary-type suction valve element 22 in the form of a cylindrical member is received in the central bore **1*a* of the cylinder block 1. The suction valve element 22 is connected to the rearmost end of the drive shaft 6 so as to be rotated together with the drive shaft. The outer circumference of the rotary-type suction valve element 22 is in sliding contact with the cylindrical inner wall of the central bore 1*a*. The axial rear end of the suction valve element 22 is axially supported by the inner wall of the suction chamber 17** via a thrust bearing.

Figure 3:
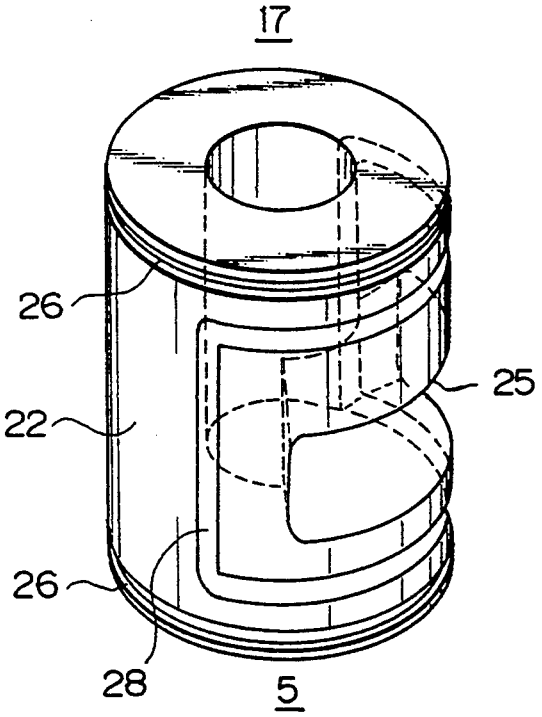
FIG. 3 is a perspective view of a rotary-type suction valve element employed in the compressor of the first embodiment of the present invention.

Referring to FIG. 3 together with FIGS. 1 and 2, the rotary-type suction valve element 22 is provided with a suction passageway 25 having a central passageway portion **25*a* extending axially inwardly from the center of the rear end of the valve element 22, i.e., the end facing the suction chamber 17. The central passageway 25*a* extends to an innermost end located at an approximately axial middle position of the valve element 22. The rotary-type suction valve element 22 is also provided with a radial passageway portion 25*b* which opens in the outer circumference of the valve element 22. The opening of the radial passageway portion 25b of the suction passageway 25 is extended in the circumferential direction over a predetermined angle so as to form a substantially quadrilateral opening, as will be understood from the illustration of FIGS. 1 and 3. The opening of the suction passageway 25 of the suction valve element 22 successively communicates with the openings of the communication passageways 2A through 2F of the cylinder block 1 when the suction valve element 22 rotates together with the drive shaft 6**.

Figure 4:
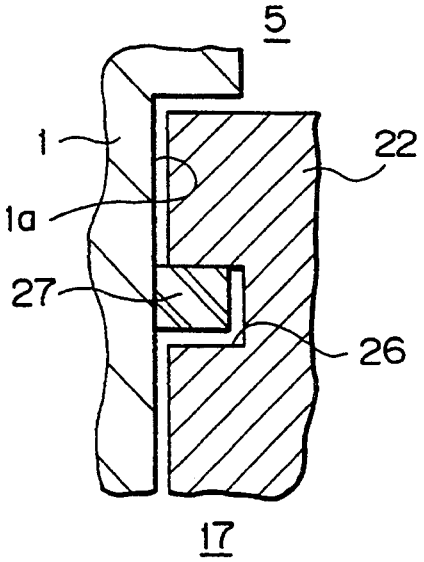
FIG. 4 is a partial cross-sectional view of the rotary-type suction valve element of FIG. 3, illustrating a sealing unit accommodated therein.

The rotary-type suction valve element 22 is further provided with annular grooves 26 arranged at positions adjacent to respective axial ends of the rotary-type suction valve element 22 as shown in FIG. 3. The annular grooves 26 of the suction valve element 22 are formed in the outer circumference so as to receive a squeeze type sealing or packing element 27 (FIG. 4) made of synthetic resin material such as polytetrafluorethylene. The squeeze type sealing element 27 is in contact with the inner wall of the central bore **1*a* of the cylinder block 1**.

The rotary-type suction valve element 22 is further provided with a grooved passageway 28 (FIG. 3) extending quadrilaterally in the outer circumference of the valve element 22 so as to surround the quadrilateral opening of the suction passageway 25 of the suction valve element 22. The grooved passageway 28 is provided to capture residual refrigerant gas under high pressure, which leaks from the respective cylinder bores 1A through 1F in the phase of an end stage of a discharging operation immediately before the suction phase into the contacting area of the outer circumference of the rotary-type suction valve 22 and the inner wall of the central bore **1*a* during rotation of the valve element 22. The grooved passageway 28 is also provided to route the captured residual gas under high pressure toward the respective cylinder bores 1A through 1F in the phase of an initial stage of the compression operation via the communication passageways 2A through 2F, respectively. Thus, the grooved passageway 28 in the form of the quadrilateral groove includes a high pressure gas capturing passageway portion 28*a*, a gas routing passageway portion 28*b*, and a pair of connecting passageway portions 28*c* interconnecting the passageways 28*a* and 28*b* as clearly shown in FIGS. 5 through 7. The high pressure gas capturing passageway portion 28*a* is spaced circumferentially from the gas routing passageway 28*b* in such a manner that when the rotary-type suction valve element 22 is rotated within the central bore 1*a* of the cylinder block 1 in the direction shown by the arrow of FIG. 2, the former passageway portion 28*a* passes by the respective openings of the communication passageways 2A** through 2F in advance of the latter passageway portion 28*b*.

The reciprocating-type refrigerant compressor having the described rotary-type suction valve element 22 is accommodated in an air-conditioning system of an automobile so as to compress the refrigerant gas and to deliver the compressed refrigerant gas toward the air-conditioning system.

The description of the operation of the compressor according to the first embodiment will be provided hereinbelow, When the drive shaft 6 (FIG. 1) of the compressor is rotated by the external drive force such as the engine of the automobile, the swash plate 9 is rotated together with the drive shaft 6 while performing a nutating motion thereof. The non-rotatable wobble plate 12 supported by the swash plate 9 carries out a nutating motion thereof to cause the reciprocation of the respective pistons 15 in the cylinder bores 1A through 1F. When the pistons 15 are moved from the top dead center thereof toward the bottom dead center thereof in the cylinder bores 1A through 1F, the latter cylinder bores 1A through 1F come into the suction phase. When the pistons 15 are moved from the bottom dead center thereof toward the top dead center thereof in the cylinder bores 1A through 1F, the latter cylinder bores 1A through 1F come into the compressing and discharging phases.

The rotary-type suction valve element 22 is rotated together with the drive shaft 6 in a predetermined direction as shown by an arrow in FIG. 2.

Figure 5:
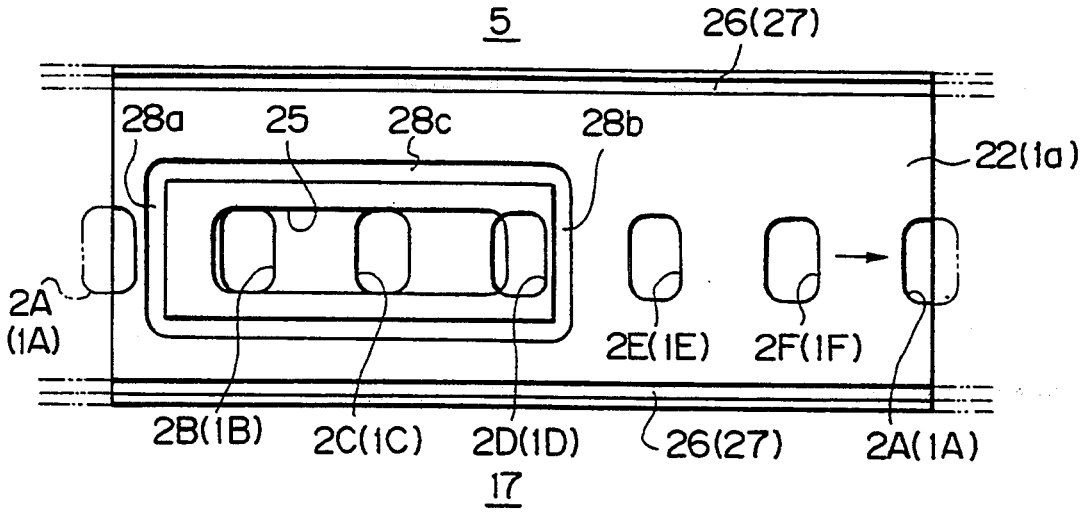
FIG. 5 is a developed view illustrating a specific positional relationship between the rotary-type suction valve element and the inner wall of the valve receiving chamber, with respect to the compressor according to the first embodiment of the present invention.
Figure 6:
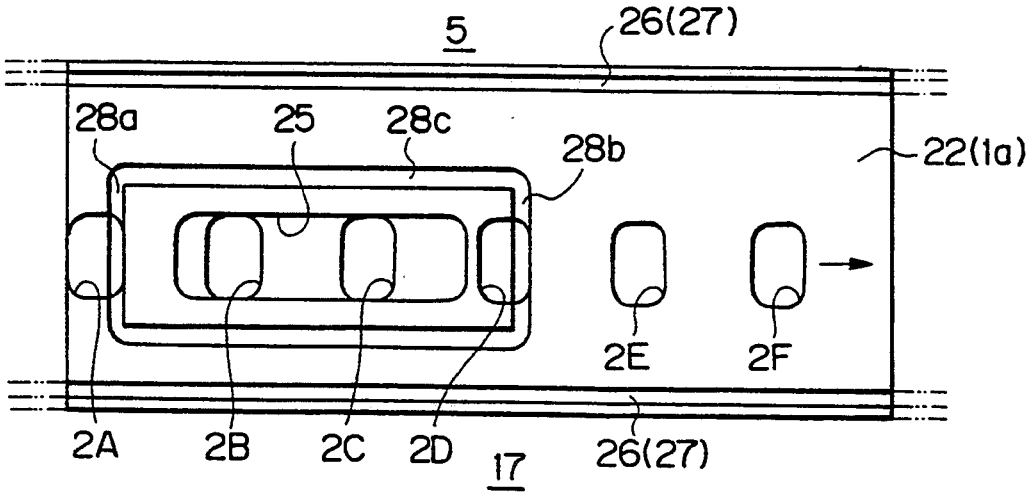
FIG. 6 is a similar developed view illustrating another specific positional relationship between the rotary-type suction valve element and the inner wall of the valve receiving chamber, with respect to the compressor according to the first embodiment.
Figure 7:
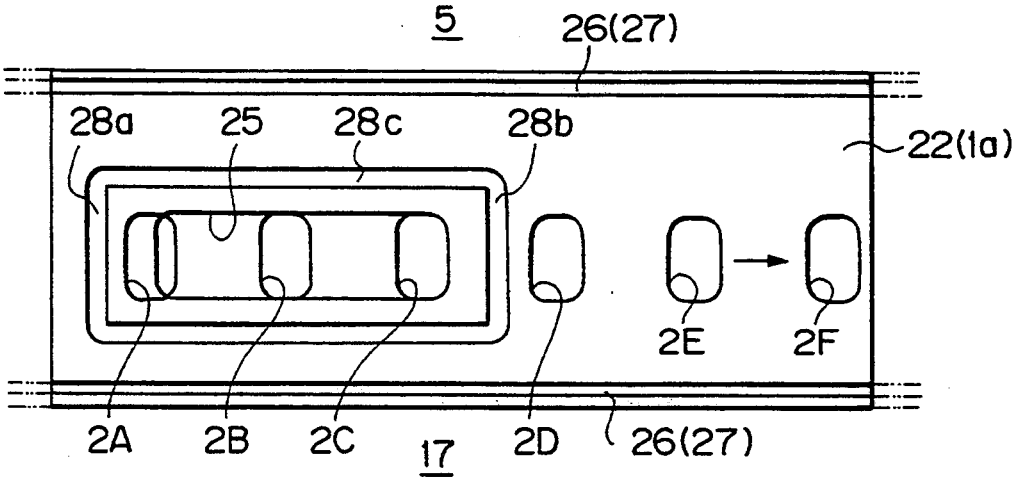
FIG. 7 is a similar developed view illustrating a further specific positional relationship between the rotary-type suction valve element and the inner wall of the valve receiving chamber, with respect to the compressor according to the first embodiment.

When the suction valve element 22 is rotated so as to occupy a position shown in FIG. 5 (FIGS. 5 through 7 are developed views of the rotary-type suction valve element 22 and the cylindrical inner wall of the central bore 1*a* of the cylinder block 1, respectively, and each arrow shown in these developed views indicates a direction in which the openings of the communication passageways 2A through 2F are relatively moved in response to the rotation of the rotary-type suction valve element 22.), the cylinder bores 1B, 1C and 1D in the suction phase communicate with the suction passageway 25 of the suction valve element 22 via the communication passageways 2B, 2C, and 2D. Thus, the refrigerant gas before compression is supplied from the suction chamber 17 of the rear housing 4 into the cylinder bores 1B, 1C and 1D via the suction passageway 25 of the suction valve element 22 and the communication passageways 2B, 2C and 2D.

On the other hand, the cylinder bores 1E and 1F in the compressing phase add the related communication passageways 2E and 2F are closed by the outer circumference of the suction valve element 22. At this stage, a gas pressure prevailing in the interior of the cylinder bores 1E and 1F is lower than that in the discharge chamber 18 of the rear housing 4, and accordingly, the discharge valves 20 of these cylinder bores 1E and 1F close the related discharge ports 3*a*.

The cylinder bore 1A in the discharging phase is disconnected from the suction passageway 25 of the suction valve element 22 as shown in FIG. 5. Namely, the opening of the communication passageway 2A of the cylinder bore 1A is closed by the outer circumference of the suction valve element 22. At this stage, a gas pressure prevailing in the cylinder bore 1A is increased to a level higher than that in the discharge chamber 18. Accordingly, the discharge valve 20 of the cylinder bore 1A is moved to the opening position thereof opening the discharge port 3*a* of the cylinder bore 1A.

When the rotary-type suction valve element 22 is rotated together with the drive shaft 6 from the position shown in FIG. 5 to successive positions shown in FIGS. 6 and 7, the cylinder bore 1A is shifted from the discharging phase toward the suction phase. Simultaneously, the cylinder bore 1D is shifted out of the suction phase toward the subsequent compression phase.

As the rotary-type suction valve element 22 is thusly rotated together with the drive shaft 6 while maintaining a predetermined timed relationship with the reciprocating movement of the respective pistons 15, each of the respective cylinder bores 1A through 1F repeats, in order, the suction phase, the compressing phase, and the discharging phase. When each of the respective cylinder bores 1A through 1F comes into the suction phase, it communicates with the suction chamber 17 through each of the respective communication passageways 2A through 2F, and the suction passageway 25 of the suction valve element 22, so that the refrigerant gas is smoothly and stably pumped in from the suction chamber 17 with the least loss of suction pressure.

When the rotary-type suction valve element 22 is rotated to the position shown in FIG. 6, the communication passageway 2A of the cylinder bore 1A undertaking the ending stage of the discharge phase communicates with the gas capturing passageway portion 28*a* of the grooved passageway 28, and accordingly, the residual gas remaining in the cylinder bore 1A enters the gas capturing passageway portion 28*a*, and is routed toward the gas routing passageway portion 28*b* via the connecting passageway portions 28*c*, and enters the cylinder bore 1D in the phase of an initial stage of the compression operation immediately after the completion of the suction phase via the communication passageway 2D.

When the rotary-type suction valve 22 is further rotated to the position of FIG. 6, the cylinder bore 1A from which the residual gas is removed comes into the suction phase. The cylinder bore 1D is shifted from the suction phase to the compressing phase. Therefore, any appreciable expansion of the residual gas occurs in the respective cylinder bores 1A through 1F at the initial stage of the suction phase. Therefore, the suction of an adequate amount of the refrigerant gas from the suction chamber 17 is smoothly carried out during rotation of the rotary-type suction valve element 22. Therefore, an adequate volumetric compression efficiency can be exhibited by the reciprocating-piston type compressor of the above-described embodiment.

During the rotation of the rotary-type suction valve element 22, when the valve element 22 is rotated to, for example, the position shown in FIG. 5, a part of the contacting area of the outer circumference of the rotary-type suction valve element 22 and the cylindrical inner wall of the central bore 1*a*, i.e., an area fluidly communicating with the cylinder bores 1E, 1F and 1A undertaking the compressing and discharging phases, via the respective communication passageways 2E, 2F and 2A, is subjected to the pressure of the refrigerant gas during compression or the residual refrigerant gas. Accordingly, there may occur a leakage of the refrigerant gas under high pressure from these cylinder bores into the above-mentioned part of the contacting area. Nevertheless, the leaking refrigerant gas under high pressure does not reach a low pressure region of the compressor, i.e., the crank chamber 5, the suction chamber 17, and the suction passageway 25 due to provision of the squeeze type packing element or seal element 27 (FIG. 4) in the grooves 26 of the suction valve element 22. Namely, the leaking gas flowing toward the opposite ends of the suction valve element 22 presses the packing or sealing element 27 against the inner wall of the central bore 1*a* of the cylinder block 1 so as to hermetically seal the contacting area. Consequently, the leaking gas under high pressure is prevented from entering the above-mentioned low pressure region of the compressor.

Further, as is understood from the illustrations of FIGS. 5 and 6, the leaking gas under high pressure is captured by the gas receiving passageway 28*a* or the connecting passageways 28*c* which are arranged so as to surround the suction passageway 25 of the suction valve element 22, and the leaking gas captured by the passageways 28*a* and 28*c* is subsequently is carried into the cylinder bore 1D in the phase of the initial stage of the compressing operation (FIG. 6), via the routing passageway 28*b* of the grooved passageway 28 and the communication passageway 2D of the cylinder block 1. Accordingly, the leaking gas is mixed with the refrigerant gas in the cylinder bore 1D in the compressing phase. Therefore, a rise in the temperature of the refrigerant gas can be suppressed. As a result, a rise in the temperature of the compressed refrigerant gas delivered by the reciprocating-piston type compressor can be prevented. Further, an adequate drive force-to-work efficiency of the compressor can be maintained.

Figure 8:
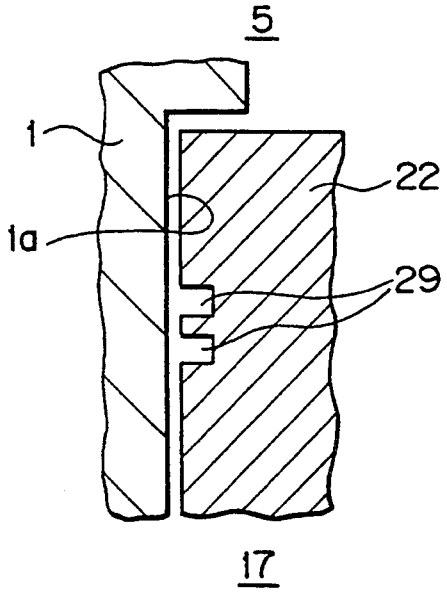
FIG. 8 is a partial Cross-sectional view of a rotary-type suction valve element of a reciprocating-piston type compressor according to a second embodiment of the present invention, illustrating a sealing unit accommodated the valve element.

Referring to FIG. 8 illustrating the reciprocating-piston type refrigerant compressor according to the second embodiment of the present invention, the rotary-type suction valve element 22 is provided with a sealing mechanism employing a labyrinth mechanism in stead of the employment of the squeeze type packing or sealing elements 27 received in the annular grooves 26 arranged adjacent to the opposite ends of the suction valve element 22.

It should be understood that the other construction of the rotary-type suction valve element 22 of the second embodiment is identical with that of the first embodiment.

The labyrinth mechanism of the suction valve element 22 of the second embodiment includes two annularly extending grooves 29 in a position adjacent to each of the axially opposite ends of the rotary-type suction valve element 22. The two grooves 29 of the labyrinth mechanism function to permit the leaking gas under high pressure to be expanded and compressed while it passes therethrough, and accordingly, the pressure of the leaking gas is lowered eventually to a level such that the gas is discouraged from flowing toward the low pressure region of the compressor such as the crank chamber 5 and the suction chamber 17.

Since the other construction of the compressor of the second embodiment is the same as that of the first embodiment, the rotary-type suction valve element 22 of the second embodiment can exhibit the same function as that of the valve element of the first embodiment.

Although the above description of the two preferred embodiments of the present invention is provided in conjunction with the reciprocating-piston type refrigerant compressor having single headed pistons reciprocated by a wobble plate mechanism, it should be appreciated that the rotary-type suction valve mechanism according to the present invention may be incorporated in a swash plate type refrigerant compressor having a central swash plate chamber in which a swash plate is rotated so as to reciprocate a plurality of double-headed pistons in respective cylinder bores arranged on both side of the swash plate chamber.

From the foregoing description of the present invention, it Will be understood that in accordance with the present invention, the volumetric compression efficiency as well as the drive force-to-work efficiency of the reciprocating-type refrigerant compressor can be adequately enhanced. Further, the rise in the temperature of the compressed refrigerant gas delivered by the reciprocating-type refrigerant compressor can be reduced.

It should be understood that various modifications and variations will occur to a person skilled in the art without departing the scope and spirit of the invention as claimed in the accompanying claims.

We claim:

1. A reciprocating-piston-type refrigerant compressor provided with a body including a cylinder block having a central bore extending axially about a central axis, a plurality of axial cylinder bores formed in the cylinder block of the body and arranged around the central axis of the cylinder block, a crank chamber formed in the body as an independent chamber separate from the cylinder bores of the cylinder block, an axial drive shaft extending through the crank chamber and rotatably supported in the body, the axial drive shaft having one end disposed in the central bore of the cylinder block, at least one suction-gas-receipt chamber formed in the body for receiving refrigerant gas before compression, and a plurality of reciprocating pistons axially slidably received in the plurality of cylinder bores and reciprocated by a piston drive mechanism arranged in the crank chamber so as to be driven by the drive shaft, comprising:

a rotary valve means connected to one end of the drive shaft so as to rotate together with said drive shaft, the rotary valve means having a generally cylindrical outer circumference extending between opposite axial ends thereof, and a suction passageway for permitting the refrigerant gas before compression to be pumped from the suction-gas-receipt chamber into respective said cylinder bores in a timed relationship with the reciprocation of said reciprocating pistons during rotation of said rotary valve means;

means for defining a recessed chamber in the central bore of the cylinder block for rotatably receiving said rotary valve means, the recessed chamber being surrounded by an inner wall area being in sealing contact with the cylindrical outer circumference of the rotary valve means; and a sealing means for providing a gas-tight sealing between the outer circumference of said rotary valve means and said inner wall area of said recessed chamber at predetermined respective positions adjacent to both of said opposite ends of said rotary valve means.

2. A reciprocating-piston-type refrigerant compressor according to claim 1, wherein said cylinder block of said body is provided with a plurality of communication passageways communicating between said central bore of said cylinder block and said plurality of cylinder bores, respectively, said plurality of communication passageways being arranged so as to fluidly communicate with said suction passageway of said rotary valve means in a timed relationship with the reciprocation of said reciprocating pistons during rotation of said rotary valve means to thereby permit the refrigerant gas before compression to be pumped into said respective cylinder bores.

3. A reciprocating-piston-type refrigerant compressor according to claim 2, wherein said sealing means comprises annular grooves formed in said outer circumference of said rotary valve means at predetermined positions adjacent to said opposite ends thereof, respectively, and annular sealing members fit in said annular grooves of said rotary valve means, said sealing members being in constantly sliding contact with said inner wall area of said recessed chamber.

4. A reciprocating-piston-type refrigerant compressor according to claim 3, wherein each of said sealing members comprises a ring-shape packing element made of plastics, and having a polygonal cross-section thereof.

5. A reciprocating-piston-type refrigerant compressor according to claim 4, wherein said ring-shape packing element of said sealing members is made of polytetrafluorethylene resin.

6. A reciprocating-piston-type refrigerant compressor according to claim 2, wherein said sealing means comprises labyrinth grooves formed in said outer circumference of said rotary valve means at predetermined positions adjacent to said opposite ends thereof, respectively.

7. A reciprocating-piston-type refrigerant compressor according to claim 1, further comprising:

a first grooved passageway means formed in said outer circumference of said rotary valve means for receiving a part of the compressed refrigerant gas remaining in said respective cylinder bores in a phase of an initial stage of a suction phase immediately after a discharging phase; and a second grooved passageway means formed in said outer circumference of said rotary valve means for routing the part of the compressed refrigerant gas received by said first grooved passageway means toward said cylinder bore in a phase of an initial stage of a compressing phase immediately after the suction phase, said second grooved passageway means being connected to said first grooved passageway means.

8. A reciprocating-piston-type refrigerant compressor according to claim 7, wherein said cylinder block of said body is provided with a plurality of communication passageways communicating between said central bore of said cylinder block and said plurality of cylinder bores, respectively, and wherein said first and second grooved passageway means comprises a single quadrilaterally extending grooved passageway formed in said outer circumference of said rotary valve means, said quadrilaterally extending grooved passageway having two axial grooved passageway components spaced apart from one another circumferentially and extending in parallel with the axis of rotation of said rotary valve means.

9. A reciprocating-piston-type refrigerant compressor according to claim 8, wherein said suction passageway of said rotary valve means comprises an axial bore-like passageway centrally bored from one of said opposite ends of said rotary valve means, and a radial passageway communicating with said axial bore-like passageway and having quadrilateral opening formed in said outer circumference of said rotary valves to be enclosed by said quadrilaterally extending grooved passageway of said first and second grooved passageway means.

10. A reciprocating-piston-type refrigerant compressor according to claim 1, wherein said piston drive mechanism arranged in said crank chamber comprises a wobble plate non-rotatably supported on a swash plate rotatable with said drive shaft to thereby form said compressor as a wobble plate type refrigerant compressor.

* * * * *